US005551990A

United States Patent [19]

Van Dijk

[11] Patent Number: 5,551,990

[45] Date of Patent: Sep. 3, 1996

[54] ENZYMATIC DISHWASHING AND RINSING COMPOSITION

[75] Inventor: Willem R. Van Dijk, Oud-Beijerland, Netherlands

[73] Assignee: Lever Brothers Company, Division of Conopco, Inc., New York, N.Y.

[21] Appl. No.: 300,581

[22] Filed: Sep. 2, 1994

Related U.S. Application Data

[63] Continuation of Ser. No. 20,884, Feb. 19, 1993, which is a continuation of Ser. No. 826,293, Jan. 27, 1992, which is a continuation of Ser. No. 563,730, Aug. 3, 1990, which is a continuation of Ser. No. 365,290, Jun. 9, 1989.

[30] Foreign Application Priority Data

Jun. 9, 1988 [GB] United Kingdom ..... 8813687

[51] Int. Cl.[6] ..... C11D 3/386

[52] U.S. Cl. ..... 134/25.2; 435/263; 134/42; 510/226

[58] Field of Search ..... 252/174.12, DIG. 12, 252/174.25; 134/42, 25.2; 435/263

[56] References Cited

U.S. PATENT DOCUMENTS

| | | | |
|---|---|---|---|
| 4,568,476 | 2/1986 | Kielman et al. | 252/95 |
| 4,597,886 | 7/1986 | Goedhart et al. | 252/95 |
| 4,810,414 | 3/1989 | Hugo-Jensen et al. | 252/174.12 |
| 4,861,509 | 8/1989 | Cornelissen et al. | 252/174.12 |
| 4,959,179 | 9/1990 | Aronson | 252/135 |
| 5,069,809 | 12/1991 | Lagerwaard et al. | 252/174.12 |
| 5,112,518 | 5/1992 | Klugkist et al. | 252/174.12 |

FOREIGN PATENT DOCUMENTS

| | | |
|---|---|---|
| 0206390A3 | 12/1986 | European Pat. Off. . |
| 0258068 | 3/1988 | European Pat. Off. . |
| 2071237 | 9/1971 | France . |

OTHER PUBLICATIONS

"Biotechnology Newswatch", 7 Mar. 1988, p. 6.

European Search Report for EP 89 30 5835, Aug. 1989.

*Primary Examiner*—Paul Lieberman
*Assistant Examiner*—Kery A. Fries
*Attorney, Agent, or Firm*—Ronald A. Koatz

[57] ABSTRACT

A dishwashing or rinsing composition comprising a surfactant and an enzyme, characterized in that the enzyme is a lipase selected from lipases produced by rDNA technique and derived ultimately from the lipase gene from *Humicola lanuginosa* (syn. Thermomyces lanuginosus), and incorporated in the composition in an amount in the range of about 0.005 to 100 LU/mg.

2 Claims, No Drawings

ENZYMATIC DISHWASHING AND RINSING COMPOSITION

This is a Continuation of U.S. Ser. No. 08/020,884, filed Feb. 19, 1993 now abandoned; which is a Continuation of U.S. Ser. No. 07/826,293, filed Jan. 27, 1992 now abandoned; which is a Continuation of U.S. Ser. No. 07/563,730, filed Aug. 3, 1990 now abandoned; which is a Continuation of U.S. Ser. No. 07/365,290, filed Jun. 9, 1989 now abandoned.

The present invention relates to an enzymatic dishwashing or rinsing composition, and concerns the use of particular lipolytic enzymes. The invention also relates to the use of the compositions in processes for (e.g. mechanical) dishwashing.

Enzymatic dishwashing compositions have been proposed in the art. As enzymes, mainly amylases and/or proteases have been proposed for inclusion in dishwashing compositions. Lipases have also been suggested, but have received far less attention than the amylases and/or proteases. Dishwashing compositions, in particular machine dishwashing compositions which are used in the main wash step of a machine dishwashing operation, have in general a satisfactory cleaning performance. However, frequently the articles cleaned with such products still do not have a satisfactory visual appearance after rinsing and drying, showing film or spots. Some main wash liquor is usually carried over from the main wash step to the rinse step, causing some deposition of soil resulting in insoluble calcium salts on the articles to be rinsed, which results in visible film or spots on the articles when they are dry. In particular with glass articles, this causes an unsightly visual appearance.

We have now found that the addition of special lipases to a main wash dishwashing composition or to a rinse composition significantly reduced the formation of film or spots on the articles cleaned or rinsed with such a composition. The special lipases, used according to the present invention are lipases produced by cloning, by rDNA technologies, the gene encoding for the lipase produced by the fungus *Humicola lanuginosa* and expressing the gene in *Aspergillus oryzae* as host. Such a lipase is manufactured and sold by Novo Industri A/S, Denmark, under the trade name Lipolase (Biotechnology Newswatch, 7 Mar. 1988, page 6). Further such lipases are mentioned in EP 0 258 068 and EP O 305 216 (NOVO) (incorporated herein by reference).

The lipases of the present invention are included in the final composition in such an amount that the final composition has a lipolytic enzyme activity of from 100 to 0.005 LU/mg preferably 25 to 0.05 LU/mg of the composition.

A Lipase Unit (LU) is that amount of lipase which produces 1 micromol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol/l $Ca^{2+}$ and 20 mmol/l NaCl in 5 mmol/l Tris-buffer.

Naturally, mixtures of the above lipases with other lipases can be used. The lipases can be used in their nonpurified form, or in a purified form, e.g. purified with the aid of well-known adsorption methods, such as a phenylsepharose-adsorption techniques.

The composition of the invention may furthermore comprise the usual ingredients of dishwashing or rinse compositions. Thus it may contain one or more alkali salts commonly used in dishwashing compositions. Thus, it may contain organic and/or inorganic builders such as the alkali metal ortho-, pyro and tripolyphosphates and hexametaphosphates, silicates, carbonates, zeolites, borates, citrates, carboxymethyloxysuccinates, nitrilotriacetates and ethylenediaminetetraacetates, polymeric polyelectrolytes such as polyacrylates, polymaleates, and other known organic and inorganic builder compounds.

Caustic alkali (e.g. NAOH) may also be additionally present, and the compositions often generate a pH>10 on dissolution/dispersion at a surfactant level in the range 0.4–0.8 g/l.

Usually, the mount of builders in the composition varies from 10–90% by weight, generally from 30–70% by weight.

The composition may also contain a detergent-active compound. If a detergent-active compound is included, it usually is in an amount of from 0.5–10%, usually 1–5%. Any well-known type of detergent active compound may be used, such as soaps, synthetic anionic, nonionic, amphoteric detergent surfactant and mixtures thereof. Preferably, a nonionic detergent surfactant is used, especially a low-foaming one. Suitable example of such nonionic detergent surfactants can easily be found in M. Schick "Nonionic Surfactants" (1967).

The compositions may furthermore contain other useful additives such as bleaching agents, bleaching agent activators, hydrotropes, fillers, perfumes, colouring agents, germicides, soil-suspending agents, aminopolyphosphonic acids and alkaili metal or alkaline earth metal salts thereof, anti-corrosion agents such as fatty acids, benztriazole and so on. Other enzymes such as proteases, e.g. Savinase® ex Novo, amylases, e.g. Termamyl® ex Novo, and oxidases may also be included.

As bleaching agents the peroxygen type bleaching agents, preferably with a bleach precursor such as TAED are suitable for inclusion in the machine dishwashing compositions.

A typical example of a conventional machine dishwashing composition usually contain an alkali metal tripolyphosphate in an amount of from 20–60%, an alkali metal silicate in an amount of from 40–80%, or an alkali metal disilicate in an amount of 5–30% by weight a peroxy type bleaching agent in an amount of from 1–15%, a low-foaming detergent surfactant in an amount of from 0.5–5%, and minor ingredients such as perfumes, colouring agents, hydrotropes, fillers, etc.

When formulated as a rinse composition, it may contain from 0.5–10% by weight of a nonionic surfactant, from 5–25% by weight of an inorganic or organic acid, from 1–5% by weight of a hydrotrope, dyes, germicides, clays, silica sols, etc., the balance being water. The products of the invention can be formulated in any desirable form, such as powders, granulates, cakes, bars, pastes, liquids, etc. When the compositions are presented as liquids, the proportions given above are (wherever appropriate) expressed in terms of the dry weight.

The invention will further be illustrated by way of example.

EXAMPLE

Glasses were cleaned in a Kenmore Sears dishwashing machine, using the normal wash programme at 50° C. followed by a hot dry. The water hardness was 14° FH. The dishwashing composition was dosed in an amount of 3 g/l and had the following formulation.

| | % by weight |
|---|---|
| sodium tripolyphosphate | 24 |
| soda ash | 20 |
| sodium disilicate | 11 |
| linear $C_{10}$ alcohol, condensed with 6 moles of ethylene oxide and 24 moles of propylene oxide | 2.5 |
| sodium sulphate | 44.0 |
| water | to 100 |

The load was a dummy load without soil, and the soiling was 35 g/run fresh egg-yolk.

The glasses were washed once and the number of spots on the glasses was thereafter determined. These experiments were carried out with and without Lipolase (dosed at 15 LU/ml), with or without Savinase (dosed at 47 GU/ml) or with Termamyl® (dosed at 80 MU/l) (see note).

The following results were obtained:

| | Number of Spots of glass |
|---|---|
| Base powder | 272 |
| Base powder + Lipolase | 22 |
| Base powder + Savinase | 274 |
| Base powder + Lipolase + Savinase | 30 |
| Base powder + Lipolase + Savinase + Termamyl | 34 |

-continued

| | Number of Spots of glass |
|---|---|

Note:
A GU is a glycine unit, which is the amount of proteolytic enzyme which under standard incubation conditions produces an amount of terminal $NH_2$-groups equivalent to 1 microgramme/ml of glycine.
An Mu is a maltose unit, as determined by the method described by P. Bernfeld in "Methods in Enzymology", Vol. I, (1955), page 149.

The invention extends to all combinations and subcombinations of the features mentioned above and in the appended claims, within the scope of the claims.

I claim:

1. A method of enhancing removal of spots from glass products in a dishwashing machine which method comprises using a dishwashing or rinsing composition consisting of 0.5 to 10.0% by wt. of a surfactant and an enzyme, wherein said enzyme is a lipase gene from *Humicola lanuginosa* (Syn. Thermomyces lanuginosus) and expressing the gene in Aspergillus as host and said enzyme is incorporated in the composition in an amount in the range of about 0.005 to 100 LU/mg.

2. A method according to claim 1, wherein said method comprises additionally using a subtilisin protease enzyme in an amount in the range of 0.1 to 50 GU/mg.

* * * * *